United States Patent [19]

Fries et al.

[11] Patent Number: 4,649,362

[45] Date of Patent: Mar. 10, 1987

[54] THERMOSTAT

[75] Inventors: Donald W. Fries, Carol Stream; David W. Troscinski, Woodridge, both of Ill.

[73] Assignee: Eaton Corporation, Cleveland, Ohio

[21] Appl. No.: 772,970

[22] Filed: Sep. 5, 1985

[51] Int. Cl.[4] ..... H01H 37/12; H01H 35/40

[52] U.S. Cl. ..... 337/323; 337/319; 200/83 S

[58] Field of Search ..... 337/323, 319, 318, 317, 337/320, 321, 327, 330; 200/83 S, 83 SA

[56] References Cited

U.S. PATENT DOCUMENTS 2,762,888 9/1956 Jacobs ..... 337/319

3,984,650 10/1976 Budlane et al. ..... 200/83 S

*Primary Examiner*—Harold Broome

*Attorney, Agent, or Firm*—D. A. Rowe; R. A. Johnston

[57] ABSTRACT

A fluid bulb-sensing type thermostat having a capillary tube from the sensing bulb connected to an inlet port of a fluid pressure sensing chamber defined in part by an expansible diaphragm which moves in response to fluid pressure in the chamber from the bulb to actuate a snap-acting switch. The diaphragm is mounted on a plate which is cantilevered from the thermostat housing, and the at-rest position of the plate with respect to the housing is adjustable by a cam against which the free end of the plate is biased, for calibrating the thermostat.

15 Claims, 3 Drawing Figures

THERMOSTAT

BACKGROUND OF THE INVENTION

The present invention relates to devices for automatically operating an electrical switching mechanism in response to sensed changes in temperature. In particular, the invention relates to such devices having a sensing element positioned remotely from the electrical switching mechanism. An example would be devices having a remote sensing element for sensing freezing conditions in a device such as a refrigerator or freezer, with switching mechanism located exteriorly of the freezing compartment. Such thermostats are known to have provided, on the switching mechanism, an adjustment for selecting the desired temperature of the freezing compartment at which the electrical switching mechanism is desired to complete an electrical circuit or alternatively, have the electrical switching mechanism break an electrical circuit, in response to a predetermined sensed temperature in the freezing compartment.

In the design of thermostats employed for cold control, it is known to provide a range adjustment on the switching mechanism for enabling the operator of the refrigeration device to select a predetermined temperature about which it is desired to regulate the operation of the device. In known thermostats, the operator adjusts an input control, as for example, a rotary positionable knob, for dialing-in the selected temperature. The knob is effective to adjust the position or changing the position of a lever mechanism responsive to the remote temperature sensor thereby controlling the point at which the switching mechanism is actuated in response to a certain movement of the lever mechanism.

In known thermostat designs, the temperature responsive element is mounted to the housing means or frame and a lever mechanism is pivoted about a fulcrum on the housing means or frame, with the initial position of the lever mechanism calibrated with respect to the at-rest position of the temperature sensing element. In such devices, it is known to have a liquid filled temperature sensing bulb remotely connected to the switching mechanism by a capillary tube which provides fluid pressure to act against a diaphragm or piston which is mounted on the frame or housing means. Calibration is accomplished by moving an adjustment for prepositioning the lever means which contacts the diaphragm on piston.

In known thermostat designs, it is necessary to adjust the initial position of the lever mechanism with respect to the actuating diaphragm or piston to calibrate the lever mechanism movement with respect to the temperature responsive actuating mechanism. It is also necessary to calibrate the lever mechanism with respect to the actuation or trip point of the switching mechanism. Providing such a dual calibration within the thermostat has provided to be extremely difficult because because movement of the lever means for calibration with respect to the temperature responsive actuating member such as the diaphragm, results in movement of the lever means with respect to the switching mechanisms. Where snap-acting switching mechanisms have been employed, it has thus been difficult to calibrate the thermostat because movement of the lever means required re-positioning of the snap-acting switch actuating member. Furthermore, it is required to provide movement of the lever means for selective of the lever means for selection of the switching actuation temperature. Thermal hysteresis of the temperature responsive element also makes such calibration difficult.

It has thus long been desired to find a way or means of providing a temperature set calibration for a thermostat in which the switch actuating lever mechanism can be initially calibrated with respect to the thermally responsive element and then separately and independently calibrated with respect to the actuation point of the switching means, with the second calibration made relative to the first calibrated position of the lever mechanism with respect to the temperature responsive element.

SUMMARY OF THE INVENTION

The present invention provides a thermostat of the type suitable for controlling operation of a motor-compressor for a refrigeration apparatus which has a remote temperature sensing element with respect to the electrical switching mechanism. The thermostat of the present invention employs a pressure responsive diaphragm which acts against a lever mechanism for actuating and deactuating an electrical switch which may be employed to energize and de-energize a refrigerant compressor motor.

The thermostat of the present invention has the pressure responsive actuator diaphragm mounted on a member cantilevered from the housing or frame; and, an adjustable stop is provided for changing the initial position of the diaphragm mounting member with respect to the housing for calibrating the lever mechanism with respect to any fixed position of the diaphragm. A pivoted lever mechanism is mounted on the housing and positioned for movement by the pressure responsive diaphragm for actuating an electrical switching mechanism.

A separate adjustment mechanism is provided for altering the trip point of the electrical switching mechanism with respect to movement of the lever means. Thus, the lever means may be calibrated with respect to the movement of the pressure responsive member for a given temperature rise; and, the trip point of the electrical switch separately calibrated with respect to the lever after the temperature calibration of the lever has been completed. An adjustment of the lever fulcrum is provided for changing the setting of the thermostat once the calibration has been effected.

DETAILED DESCRIPTION

Figure 1:
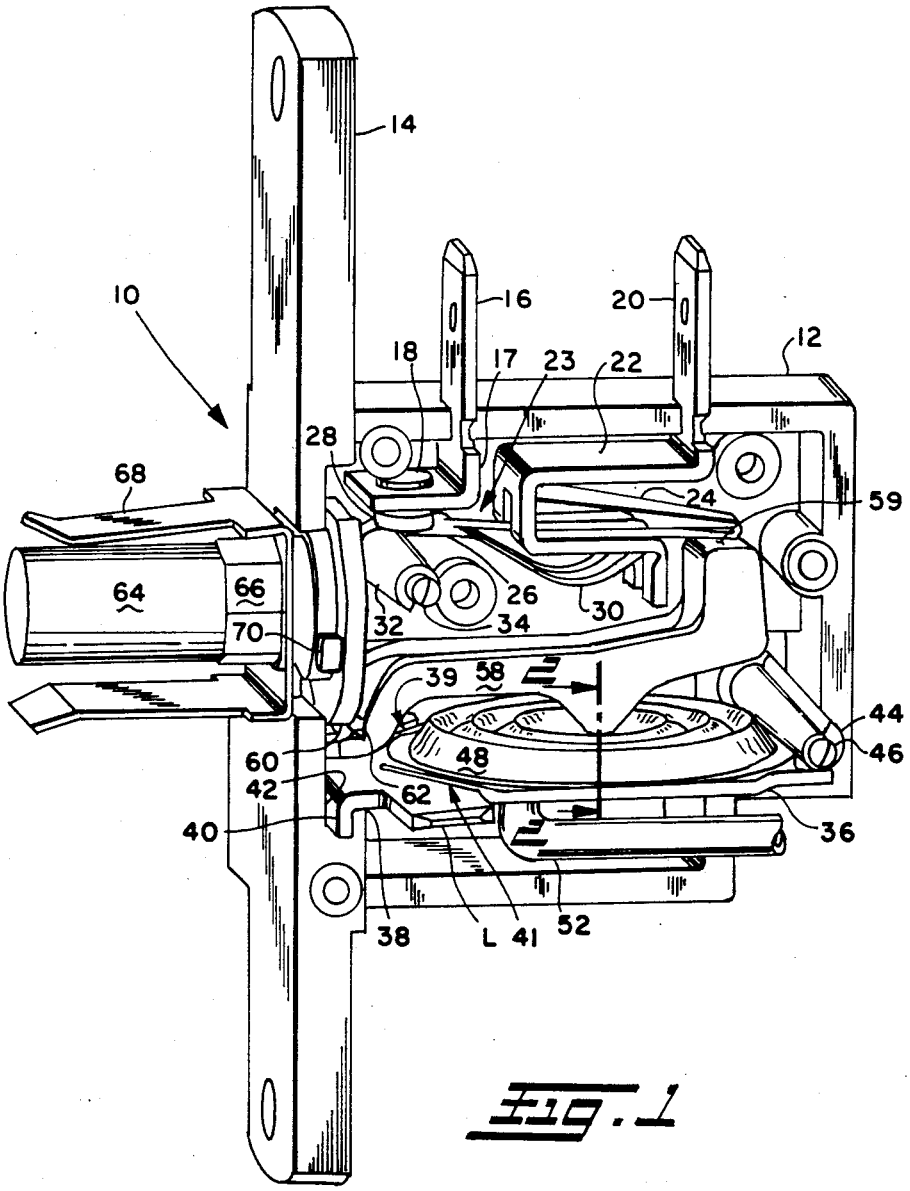
FIG. 1 is a side view in elevation of the thermostat of the present invention with the housing cover removed.

Referring to FIG. 1, the thermostat of the present invention is indicated generally at 10 as having a mounting frame 12, with an attachment bracket portion 14 adapted for fastening to a panel or other structure of the device to be controlled such as the wall of a refrigeration compartment. Frame 12 has an electrical terminal 16 mounted thereon and extending outwardly therefrom and with a portion 17 thereof extending interiorly of the frame with a stationary electrical contact 18 mounted thereon. A second electrical terminal 20 is mounted on frame 12 in spaced parallel relationship to the terminal 16, with the terminal 20 having a portion 22 extending interiorly of the frame 12. A switching mechanism, indicated generally at 23, which preferably has a snap action mechanism, is provided having a moveable blade actuator member 24. The blade actuator member 24 has an elongated portion 26 extending therefrom with a moveable electrical contact 28 mounted on the end thereof. Rotary cam 32 provides an adjustable limit stop for the contact 28.

Figure 3:
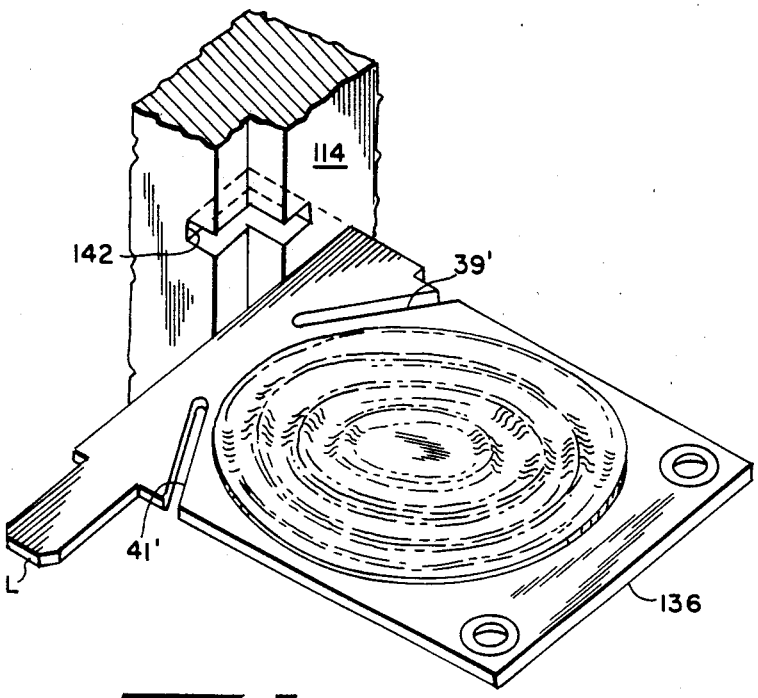

A plate member 36 having a generally thin flat configuration is provided and has a reduced width portion 38 provided at one end thereof, which portion 38 has a flange 40 formed thereon. In the FIG. 1 embodiment, flange 40 is received in a groove 42 provided in the bracket 14. The flange 40 attaches the narrow portion 38 of the plate to the bracket 14 in moment resisting cantilever arrangement. Referring to FIGS. 1 and 3, plate 36 in both illustrated embodiments has a pair of slots or recesses 39, 41 and 39', 41', respectively, formed therein disposed adjacent the end of the plate 36 anchored to bracket 14; and, in the embodiment of FIG. 1, only one of the two slots, namely slot 41 is visible. The purpose of the slots 39, 41 and 39', 41' is common in both illustrated embodiments; namely, to reduce the bending stiffness locally in the plate such that nearly all of the flexure, due to cantilever end loading of the plate, occurs in the region adjacent the mounted end. This arrangement substantially eliminates bending flexure of the plate 36 in the region of diaphragm attachment, thereby virtually straining of the diaphragm bond to plate 36 as will be described below.

The free end of the plate is inherently spring biased at installation against a stop comprising a rotary cam 44 disposed adjacent the free end of the plate 36. Cam 44 is rotatable about post 46, extending from the mounting frame, for adjusting the position of the plate 36 with respect to the frame 12.

Figure 2:
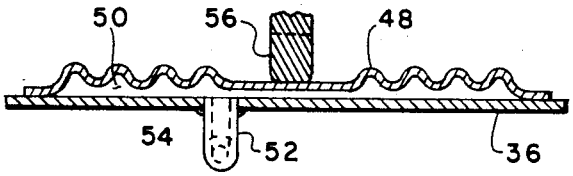
FIG. 2 is a section view taken along section-indicating lines 2—2 of FIG. 1; and, FIG. 3 is a perspective view of an alternative method of mounting the diaphragm plate to the frame.

Referring now to FIGS. 1 and 2, the plate 36 has mounted thereon a circularly convoluted diaphragm 48, which, in the presently preferred practice, is a thin metal member rigidly attached about the periphery thereof to the plate 36, as, for example, by weldment or adhesive bonding. The captured region between the under surface of diaphragm 48 and the upper surface of plate 36.

A fluid pressure conduit, in the form of capillary tube 52, is received through an aperture 54 provided in the plate 36 and secured thereon, as for example, by brazing or welding; and, and the bore of the tube 52 is arranged to communicate with the pressure chamber 50. The remaining end of the tube 52 is connected to a fluid filled temperature sensing bulb (not shown) and which it will be understood, is disposed at a suitable location within the refrigerated compartment to sense the temperature thereof.

The central region of the diaphragm 48 bears against a contact lug portion 56 provided on a lever means 58 intermediate the ends thereof. Lever means 58 has the end thereof disposed near actuator 24 and configured so as to contact the switch actuator 24 along the surface 59. The opposite end of the lever means 58 has a fulcrum surface 62 formed thereon, which contacts the cam surface 60, rotatably mounted on the frame bracket 14. The cam surface 60 is attached by shaft means (not shown) extending, through the bracket to a knob 64, which has polygonal surfaces 66 adjacent the base thereof to facilitate manual rotation of the knob in cam surface 60. If desired, a suitable friction or detent bracket 68 may be provided to retain the knob and cam in a selected position. A rotary position stop 70 is provided on the axial face of the cam 60 adjacent the bracket and extends radially in amounts sufficient to contact a corresponding limit (not shown) surface provided on the bracket 14.

Referring now to FIG. 3, an alternate embodiment of the invention is illustrated wherein the diaphragm support plate 136 has the margins thereof configured to be received in a groove 142 provided in the mounting bracket 114 in planar sliding arrangement to provide moment resisting attachment to the bracket 114. The plate 136 has slots 39', 41' provided therein adjacent the anchored end, to localize the bending flexure, as described hereinabove with respect to the embodiment of FIG. 1. It will be understood that the FIG. 3 embodiment has both opposite sides of the plate retained in a suitable groove; and, only one such groove 142 is illustrated in the drawings for simplicity.

In both the embodiments illustrated in FIG. 1 and FIG. 3, a suitable electrical grounding lug "L" is provided extending from the side of the plate and is adapted for solder attachment of a grounding lead thereto.

The present invention thus provides a unique and novel thermostat in which the pressure responsive diaphragm is mounted on a cantilevered plate, which may be position-adjusted on the mounting frame for temperature calibration of the thermostat.

In operation, calibration is accomplished by initially positioning the knob 64 such that the fulcrum 62 of the lever is in the approximate mid-position of the vertically permissible movement by the cam 60. The diaphragm is then pressurized until the switch mechanism 23 is actuated and a contact set 18, 28 closes to complete its circuit. Next, the cam 44 is rotated to lower the plate 36 until the point is reached at which the switch 23 deactuates and contact set 18, 23 open. The final step of the calibration comprises rotating the cam 32 until the switching mechanism 23 closes.

Subsequent settings of the thermostat are selected by rotating the knob 64 to a position wherein the diaphragm will cause the lever means 58 to actuate the switching mechanism 23 at a desired fluid pressure in chamber 50 corresponding to the desired temperature sensed by the sensing bulb.

Although the invention has hereinabove been described with respect to the illustrated embodiments, it will be understood that modifications and variations may be made to the structures illustrated and described without departing from the scope of the invention which is more particularly set forth by the following claims.

We claim:

1. An improved thermostat comprising:

(a) base frame means;

(b) plate means cantilevered from said base frame means;

(c) expansible wall means mounted on said plate means defining therewith a fluid chamber;

(d) conduit means defining a fluid port in said plate means and communicating with said chamber, said conduit means adapted for external fluid pressure communication therewith;

(e) lever means pivoted on said base frame means and having a force transmitting surface thereof contacting said expansible wall means;

(f) means adjustably positioning the free end of said plate means with respect to said base frame means;

(g) cam means operative to adjustably position said lever means with respect to said base frame means;

(h) switch means having an actuator member contacting said lever means, wherein said cam means is operable to vary the position of said lever means and the actuation point of said switch means; and, (i) temperature sensing means connected to said conduit means and operative to provide fluid pressure changes in said chamber in response to sensed temperature changes.

2. The thermostat defined in claim 1, wherein said lever means is fulcrummed on said cam means.

3. The thermostat defined in claim 1, wherein said switch means includes a snap-action mechanism.

4. The device defined in claim 1, wherein said expansible wall means comprises a concentrically convoluted diaphragm.

5. The thermostat defined in claim 1, wherein said means positioning said plate means includes rotary cam means.

6. The thermostat defined in claim 1, wherein;

(a) said switch means comprises a snap-acting mechanism having a moveable contact attached to said actuator member and a stationary member; and, (b) means adjusting the unactuated position of said moveable contact when said switch is open circuit;

7. An improved thermostat comprising:

(a) base frame means adapted for mounting to a control panel;

(b) plate means mounted on said base frame means, said plate means resiliently deformable to a plurality of positions with respect to said base frame means;

(c) expansible wall means cooperating with said plate means and defining therewith a sensing chamber;

(d) conduit means defining a fluid supply port in said sensing chamber and adapted for attachment to source of sensing fluid;

(e) temperature sensing means connected to said conduit means and operative to provide a fluid pressure signal thereto, in response to changes in the temperature sensed for effecting movement of said wall means;

(f) switch means including an actuator member operative upon certain movement to effect making and breaking of a set of electrical contacts;

(g) lever means pivoted on said base frame means and operable to transmit motion from said expansible wall means to said switch actuator member;

(h) range select means operative upon adjustment to preselect the position of said plate means with respect to said base from means; and, (i) temperature selecting means operative upon adjustment to vary the initial position of said lever means with respect to said base frame means.

8. The thermostat defined in claim 7, wherein said range select means comprises a rotary cam biased against said plate means for, upon rotation, effecting deflation of said plate means.

9. The thermostat defined in claim 7 further comprising adjustable stop means disposed on said base from means and operable to vary the spacing of said set of contacts in the circuit breaking condition.

10. The thermostat defined in claim 7, wherein said temperature selecting means comprises a rotary cam contacting said lever means at one end thereof and thereby forming the pivot for said lever means.

11. The thermostat defined in claim 7, wherein said switch actuator means is operative to bias said lever means into contact with said expansible wall means.

12. An improved thermostat comprising:

(a) base means having switch means thereof operative upon actuation and deactuation to close and open a set of contacts;

(b) lever means operative on movement to cause actuation and deactuation of said switch means;

(c) pressure responsive means contacting said lever means and operative upon receipt of a fluid pressure temperature signal to move said lever means, said pressure responsive means having:

(i) a plate member cantilevered from said base means at one end thereof;

(ii) flexible diaphragm means attached to said plate means and defining therewith a bressure chamber for receiving said fluid pressure signal, wherein said flexible diaphragm contacts said lever means; and, (d) adjustable stop means for presetting the position of the free end portion of said plate means for calibrating said pressure responsive means with respact to said lever means.

13. The thermostat defined in claim 12, wherein said plate member has a reduced transverse section in the region of said cantilevered end for localizing cantilever bending upon deflection by said adjustable stop means.

14. The thermostat defined in claim 12, further comprising second adjustable stop means for presetting the initial position of said lever means.

15. The thermostat defined in claim 12, wherein said switch means includes a snap-acting blade mechanism and, third adjustable stop means for presetting the reactuated position of said contact set.

* * * * *